US008245657B2

(12) United States Patent
Ross et al.

(10) Patent No.: US 8,245,657 B2
(45) Date of Patent: Aug. 21, 2012

(54) PERSONAL WATERCRAFT WITH PIVOTABLE PLATFORM

(75) Inventors: Kim Ross, Valcourt (CA); Sebastien Clement, St-Elie d'Orford (CA); Andre Cote, Longueuil (CA); Richard Simard, St-Charles de Drummond (CA); Gilbert Lefrancois, Magog (CA)

(73) Assignee: Bombardier Recreational Products Inc., Valcourt (CA)

( * ) Notice: Subject to any disclaimer, the term of this patent is extended or adjusted under 35 U.S.C. 154(b) by 254 days.

(21) Appl. No.: 12/755,017

(22) Filed: Apr. 6, 2010

(65) Prior Publication Data

US 2010/0186649 A1 Jul. 29, 2010

Related U.S. Application Data

(63) Continuation of application No. 11/962,266, filed on Dec. 21, 2007, now Pat. No. 7,748,334.

(51) Int. Cl.
*B63B 35/73* (2006.01)

(52) U.S. Cl. ..... 114/55.53

(58) Field of Classification Search ..... 114/55.51, 114/55.53, 362; 440/111
See application file for complete search history.

(56) References Cited

U.S. PATENT DOCUMENTS

| | | | | |
|---|---|---|---|---|
| 4,909,176 | A | 3/1990 | Kobayashi | |
| 5,676,086 | A | 10/1997 | Watkins | |
| 6,192,823 | B1 | 2/2001 | Tsumiyama et al. | |
| 6,276,290 | B1 | 8/2001 | Yamada et al. | |
| 6,651,573 | B2 | 11/2003 | Aselton et al. | |
| 6,699,088 | B2 | 3/2004 | Gokan | |
| 6,837,173 | B2 | 1/2005 | Eck et al. | |
| 2004/0123791 | A1 * | 7/2004 | Ichihara et al. | 114/362 |
| 2005/0042946 | A1 | 2/2005 | Longpre | |

* cited by examiner

*Primary Examiner* — Edwin Swinehart
(74) *Attorney, Agent, or Firm* — Osler, Hoskin & Harcourt LLP

(57) ABSTRACT

A personal watercraft is disclosed, having a straddle-type seat disposed on a deck. The seat has a seat profile. A storage compartment is disposed rearwardly of the seat. A rear platform is pivotally connected to a rear portion of the watercraft. The rear portion has a raised portion protruding therefrom. The raised portion of the rear portion forms at least in part the storage compartment. The rear platform permits access to the storage compartment when in a raised position, and sealingly closes the storage compartment when in a lowered position. A highest point of the rear platform is disposed lower than the seat profile when the rear platform is in the lowered position.

5 Claims, 18 Drawing Sheets

PERSONAL WATERCRAFT WITH PIVOTABLE PLATFORM

CROSS-REFERENCE

The present application is a continuation of U.S. patent application Ser. No. 11/962,266, entitled 'Personal Watercraft with Pivotable Platform', filed Dec. 21, 2007, the entirety of which is incorporated herein by reference.

FIELD OF THE INVENTION

The present invention relates to personal watercraft having a rear platform.

BACKGROUND OF THE INVENTION

Most of today's commercially available personal watercraft have a hull and a deck disposed thereon. The deck has a pedestal onto which a straddle-type seat is disposed for supporting one or more passengers.

In designing a personal watercraft, many features must be provided in a relatively small space. As such, there is typically very little storage space provided for storing objects such as safety or emergency equipment or the possessions of the passengers. One of the only spaces where additional storage could be located is at the rear portion of the watercraft.

However, it is normally desired to use the rear portion of the watercraft for other purposes. For example, the rear portion may serve as a platform on which riders may step for boarding the watercraft from land. The rear platform may also be used to board the watercraft from the water, for example if the rear of the watercraft is equipped with a ladder and/or grab handles for this purpose. The rider may desire to sit, kneel or stand on the rear platform while boarding the watercraft or at any other time. The weight of the rider on the rear platform may cause the rear platform to be at least partially submerged in the body of water, resulting in discomfort. The rear portion of the watercraft may also allow water that collects in the foot wells to exit the watercraft by flowing over the transom.

In addition, personal watercraft may be used for towing a person on water skis, a wakeboard or the like. When the watercraft is used in this manner, it is common for a passenger of the watercraft to sit at the rear portion of the watercraft, facing rearwardly, to act as a spotter for the person being towed. In this position, the spotter is turned to face the person being towed, and he may desire to rest his feet on the rear portion of the watercraft. When a passenger is seated in this position, his feet may be in the path of water draining from the watercraft, resulting in discomfort.

The provision of storage at the rear of the watercraft detracts from these other purposes, particularly if the height of the rear portion of the watercraft is increased to allow for a desired volume of storage space. In addition, some mechanism must be provided to gain access to the stored articles when desired and seal the storage space against water entry or loss of items when it is not being accessed, and this may interfere with the use of the rear of the watercraft for other purposes.

Therefore, there is a need for a personal watercraft having storage space on the rear portion thereof, without detracting from other uses of the rear portion of the watercraft.

SUMMARY OF THE INVENTION

It is an object of the present invention to ameliorate at least some of the inconveniences present in the prior art.

It is also an object of the present invention to provide a personal watercraft having storage space, without detracting from other uses of the rear portion of the watercraft.

It is also an object of the present invention to provide a personal watercraft having a rear storage compartment and a pivotable platform disposed above the storage compartment.

In one aspect, the invention provides a personal watercraft comprising a hull. A deck is disposed above the hull. The deck has a rear portion. The rear portion has a raised portion protruding therefrom. An engine is disposed at least in part in the hull. A propulsion system is connected to the hull and is operatively connected to the engine. A helm assembly is disposed on the deck. A straddle-type seat is disposed on the deck at least in part rearwardly of the helm assembly. The seat has a seat profile. A storage compartment is disposed at least in part rearwardly of the seat. The raised portion of the rear portion forms at least in part the storage compartment. A rear platform is pivotally connected to a rear portion of the watercraft. The rear platform extends laterally across the rear portion of the watercraft. The rear platform is pivotable relative to the hull about a pivot axis between a raised position and a lowered position. The rear platform permits access to the storage compartment when in the raised position. The rear platform sealingly closes the storage compartment when in the lowered position. A highest point of the rear platform is disposed lower than the seat profile when the rear platform is in the lowered position.

In a further aspect, a sub-deck is disposed on the hull. The hull and sub-deck together form a hull and sub-deck (HSD) assembly. The engine is disposed in the HSD assembly. The deck is disposed above the sub-deck. The raised portion protrudes from the sub-deck.

In a further aspect, a sealing ring is disposed on one of the rear platform and an outer edge of the storage compartment. The rear platform sealingly closes the storage compartment when in the lowered position by compressing the sealing ring between the rear platform and the outer edge of the storage compartment.

In a further aspect, a latch has a first portion disposed on the rear platform and a second portion disposed on one of the deck and the sub-deck. The first portion selectively engages the second portion when the rear platform is in the lowered position and prevents the rear platform from moving to the raised position.

In a further aspect, the pivot axis is disposed rearwardly of the storage compartment and oriented generally transversely.

In a further aspect, a rearward portion of the rear platform has at least one grab handle disposed thereon.

In a further aspect, the pivot axis is generally longitudinally aligned with the at least one grab handle.

For purposes of this application, terms related to spatial orientation such as forwardly, rearwardly, left, and right, are as they would normally be understood by a driver of the vehicle sitting thereon in a normal riding position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 5:
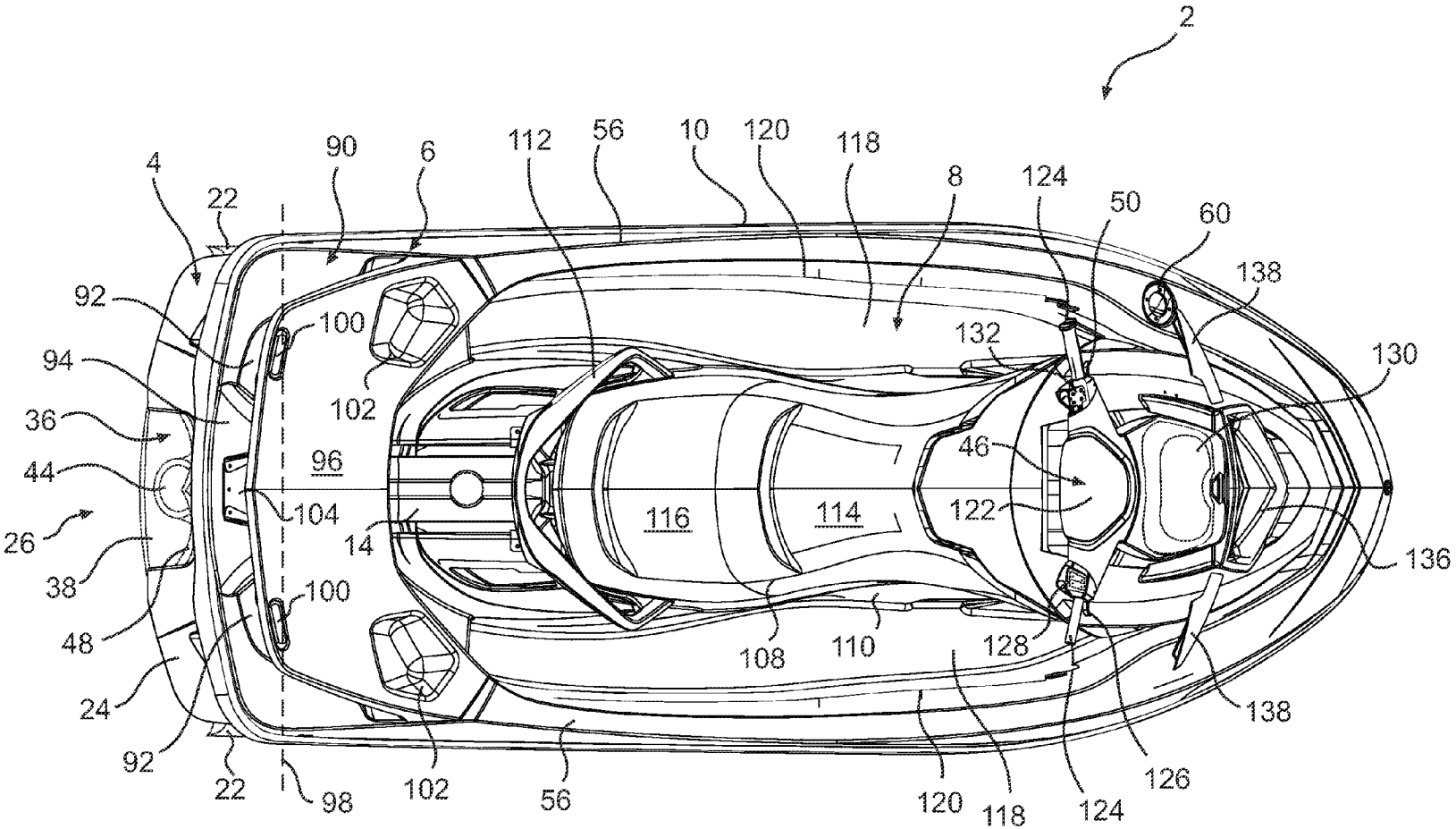
FIG. 5 is a perspective view, taken from a top, rear side, of the watercraft of FIG. 1.
Figure 6:
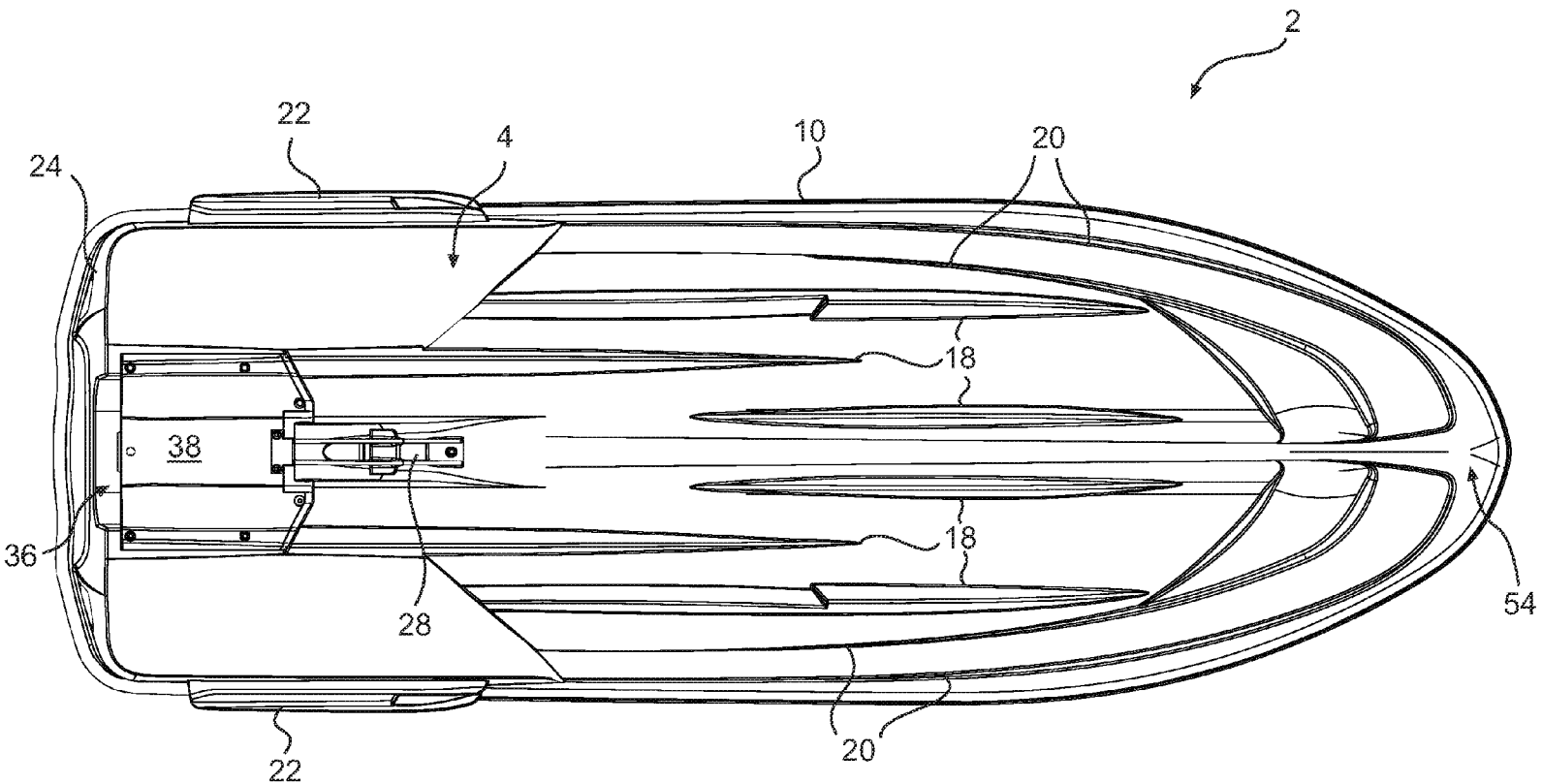
FIG. 6 is a bottom plan view of the watercraft of FIG. 1.
Figure 7:
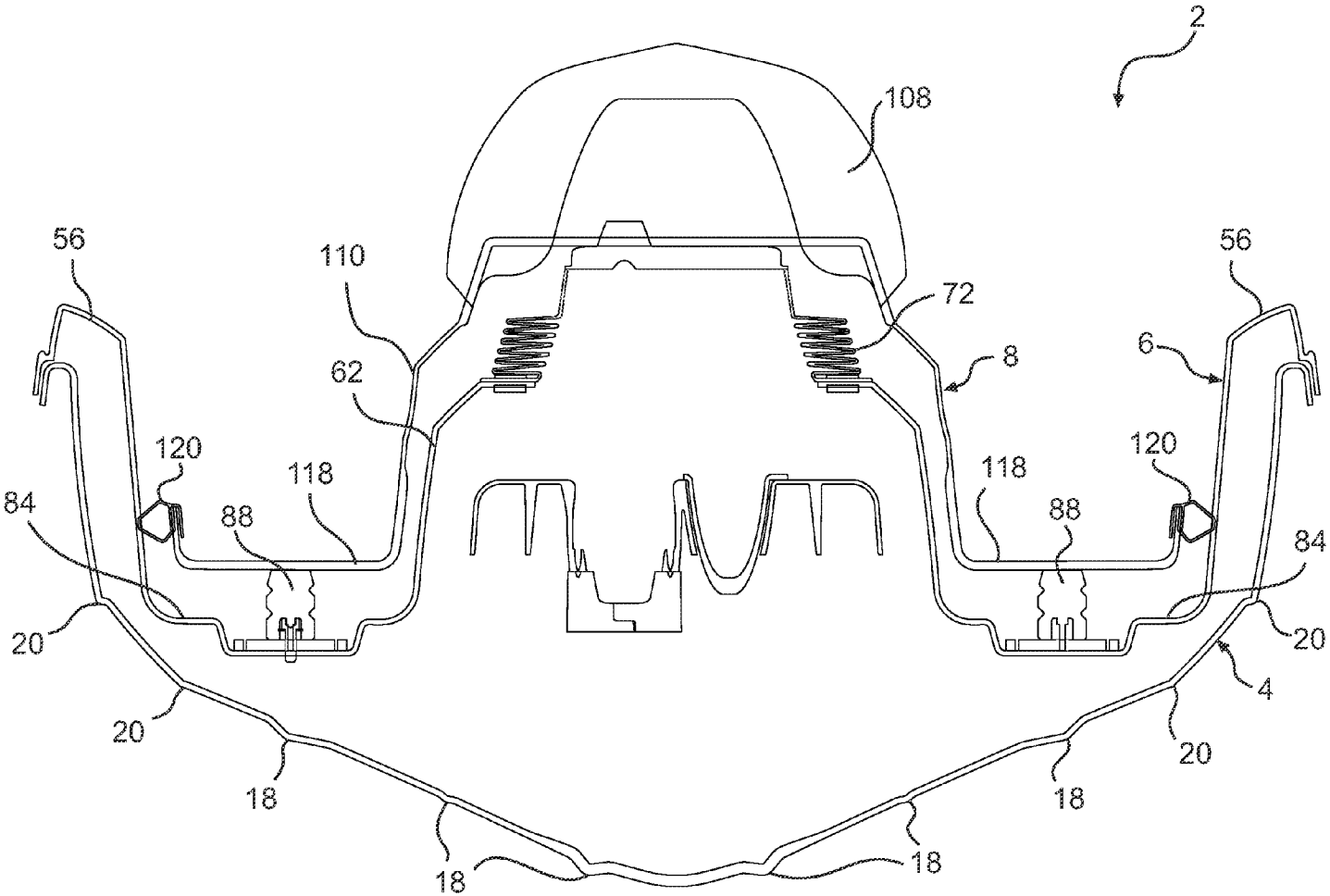
FIG. 7 is a schematic view of a transverse cross-section of the watercraft of FIG. 1.
Figure 8:
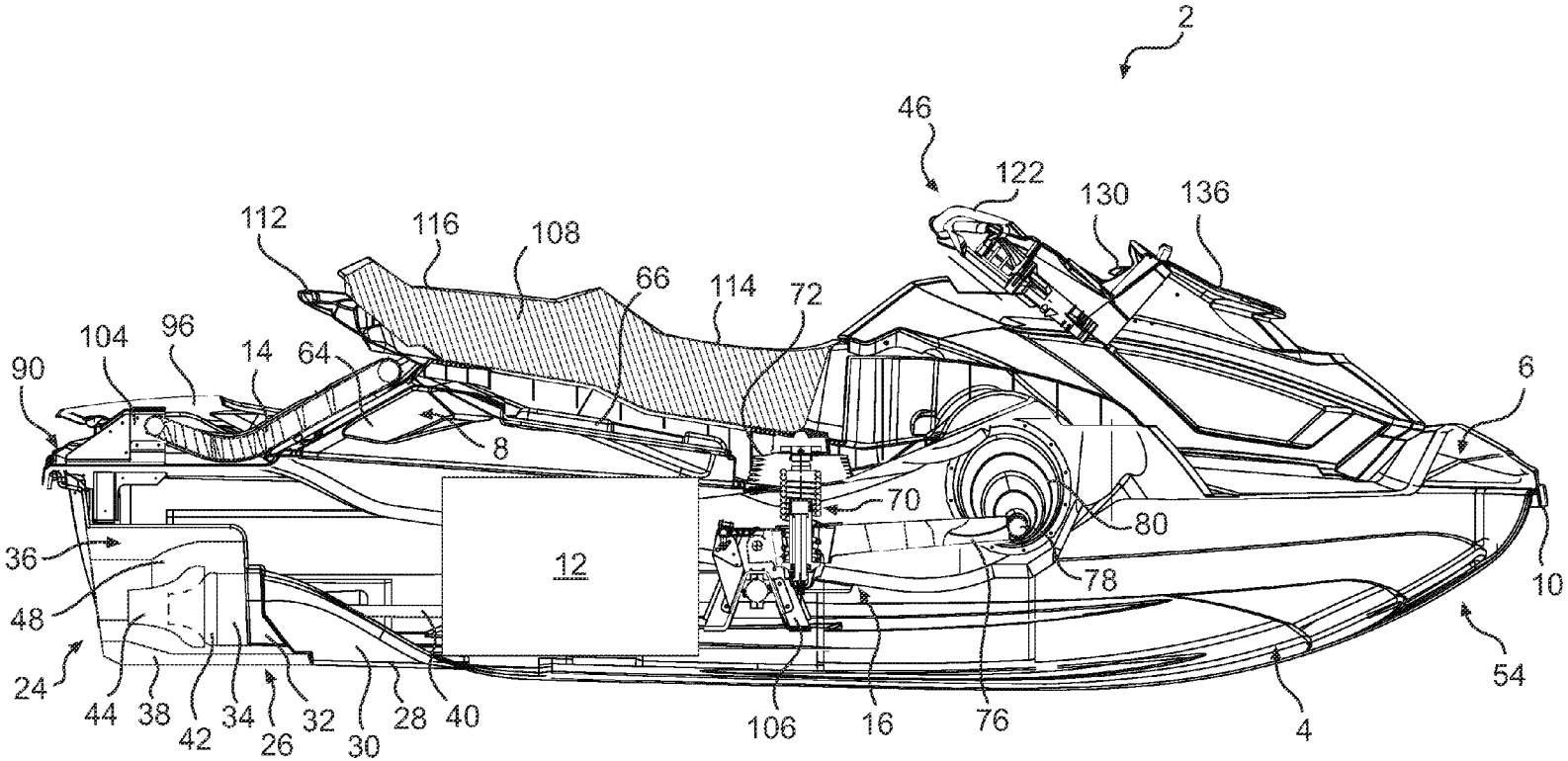
FIG. 8 is a partial longitudinal cross-section of the watercraft of FIG. 1 showing some of the internal components thereof.
Figure 9:
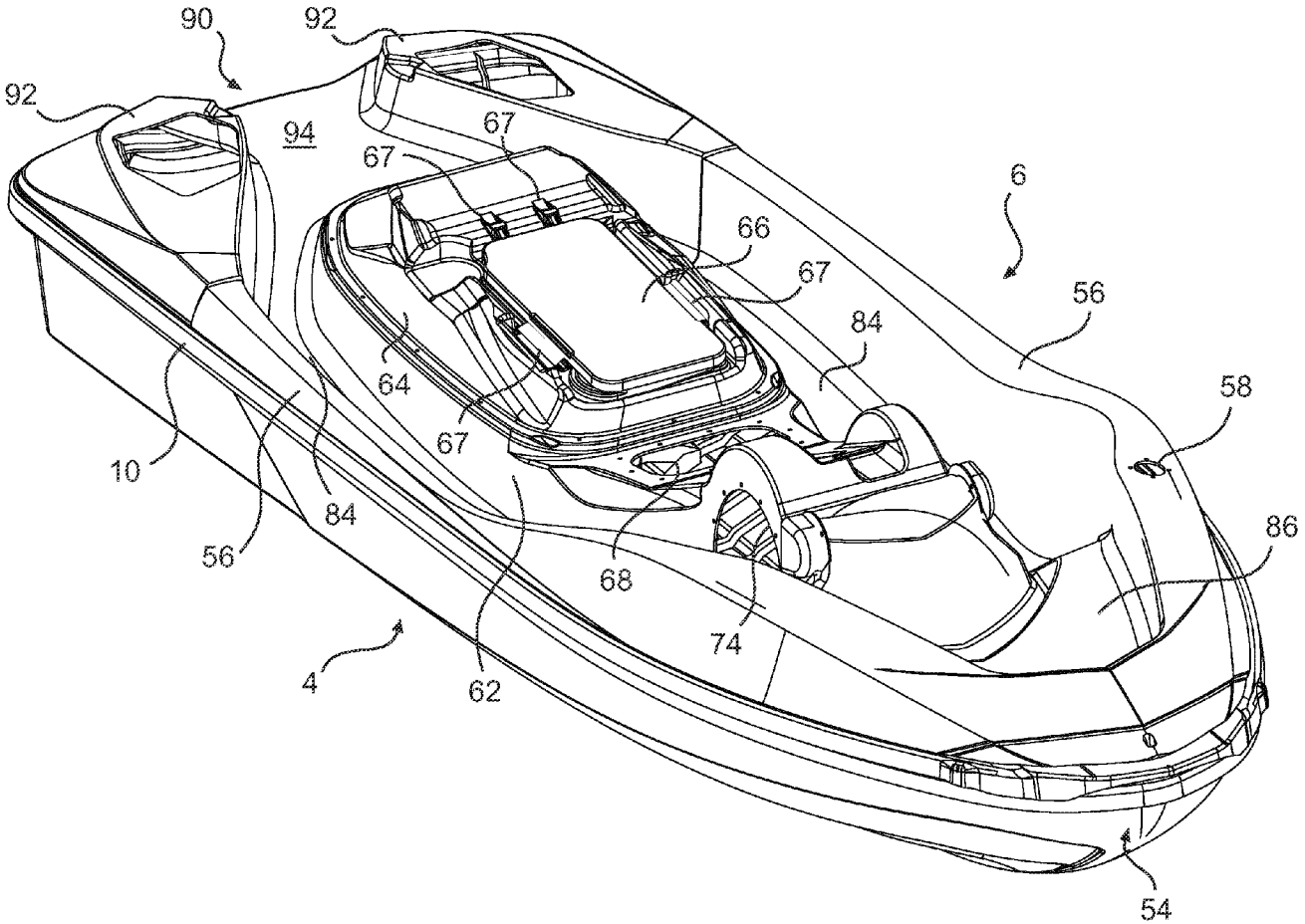
FIG. 9 is a perspective view, taken from a front, right side, of a hull and sub-deck assembly of the watercraft of FIG. 1, with the engine cowling thereon.
Figure 10:
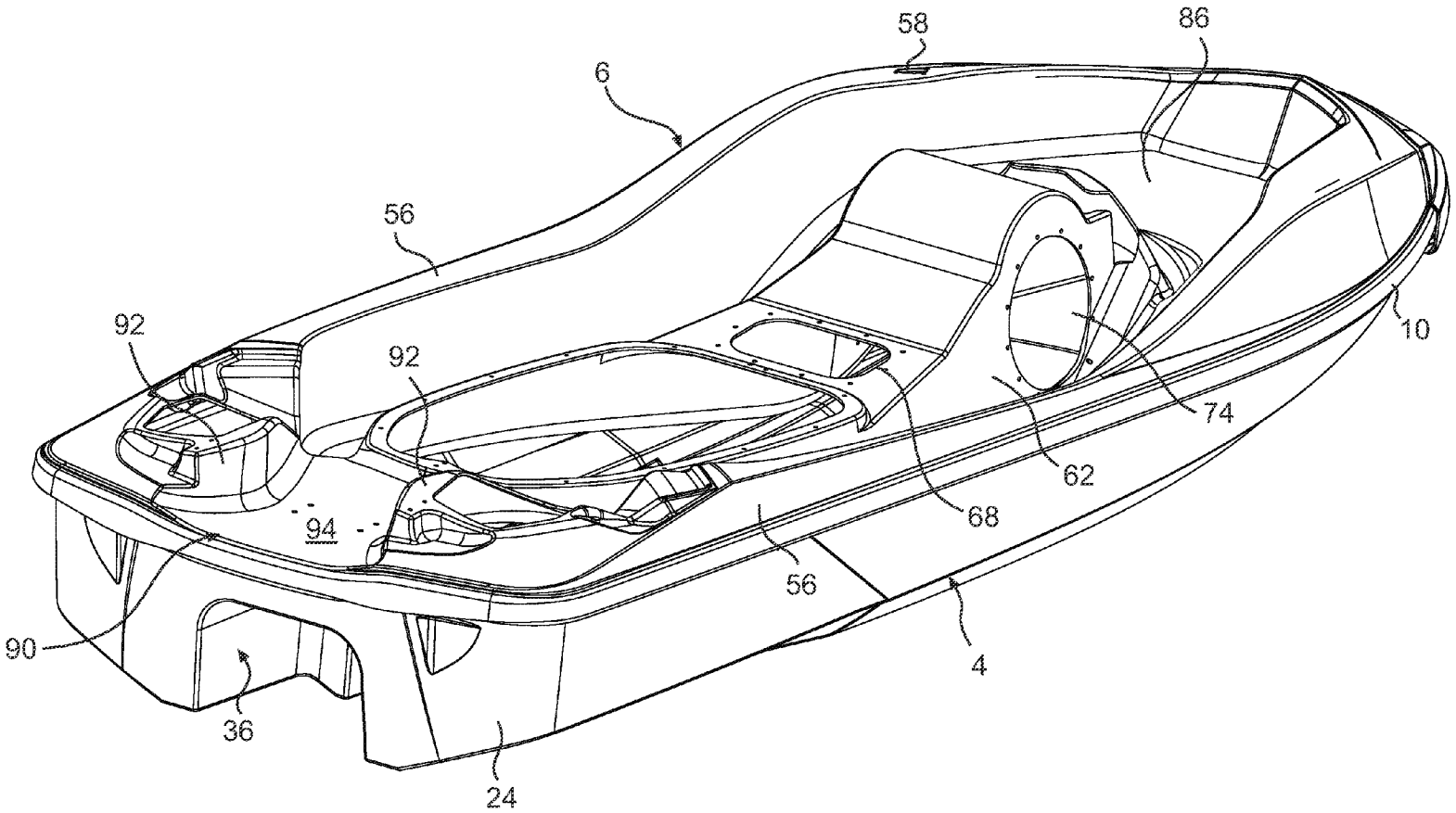
FIG. 10 is a perspective view, taken from a rear, right side, of the hull and sub-deck assembly of FIG. 9, with the engine cowling removed.
Figure 11:
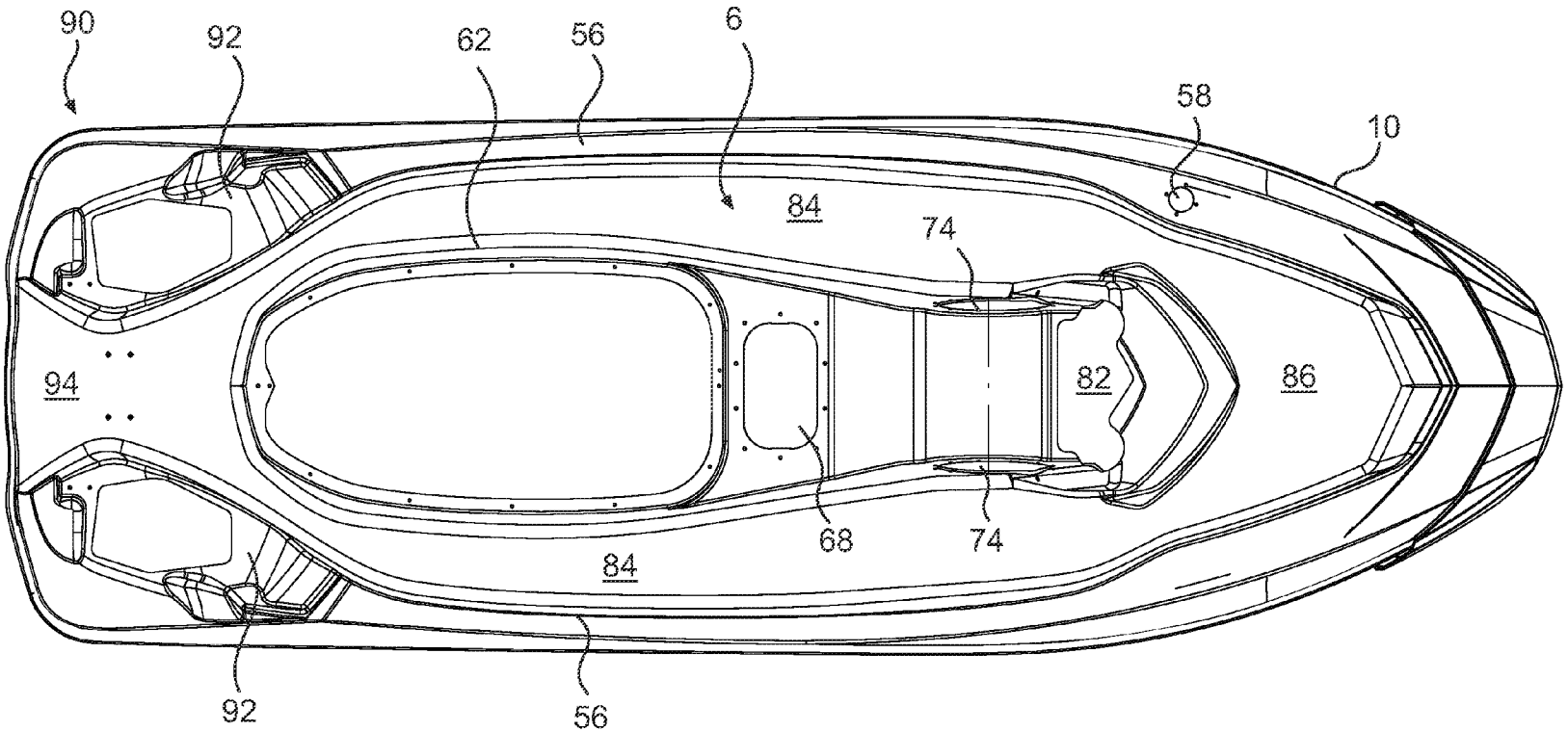
FIG. 11 is a top plan view of the hull and sub-deck assembly of FIG. 9, with the engine cowling removed.

Turning to FIGS. 1 to 12, a personal watercraft 2 will be described. The watercraft 2 is made of three main parts. These parts are the hull 4, the sub-deck 6, and the deck 8. As best seen in FIGS. 9 to 11, the hull 4 and sub-deck 6 are joined together, preferably by an adhesive, to form a hull and sub-deck (HSD) assembly. Rivets or other fasteners may also join the hull 4 and sub-deck 6. A bumper 10 generally covers the joint helping to prevent damage to the outer edge of the watercraft 2 when the watercraft 2 is docked. The volume created between the hull 4 and the sub-deck 6 is known as the engine compartment. The engine compartment accommodates the engine 12 (schematically shown in FIG. 8) as well as the muffler, exhaust pipe, gas tank, electrical system (including for example a battery and an electronic control unit), air box, storage bins (not shown) and other elements required by or desired for the watercraft 2. The deck 8 (FIG. 3) is designed to accommodate a driver and one or more passengers. As best seen in FIGS. 7 and 8, the deck 8 is suspended on the HSD assembly by a rear suspension member in the form of a rear suspension arm 14 and a front suspension assembly 16 described in greater detail below. It is contemplated that the deck 8 could be fixedly connected to the HSD assembly.

Figure 1:
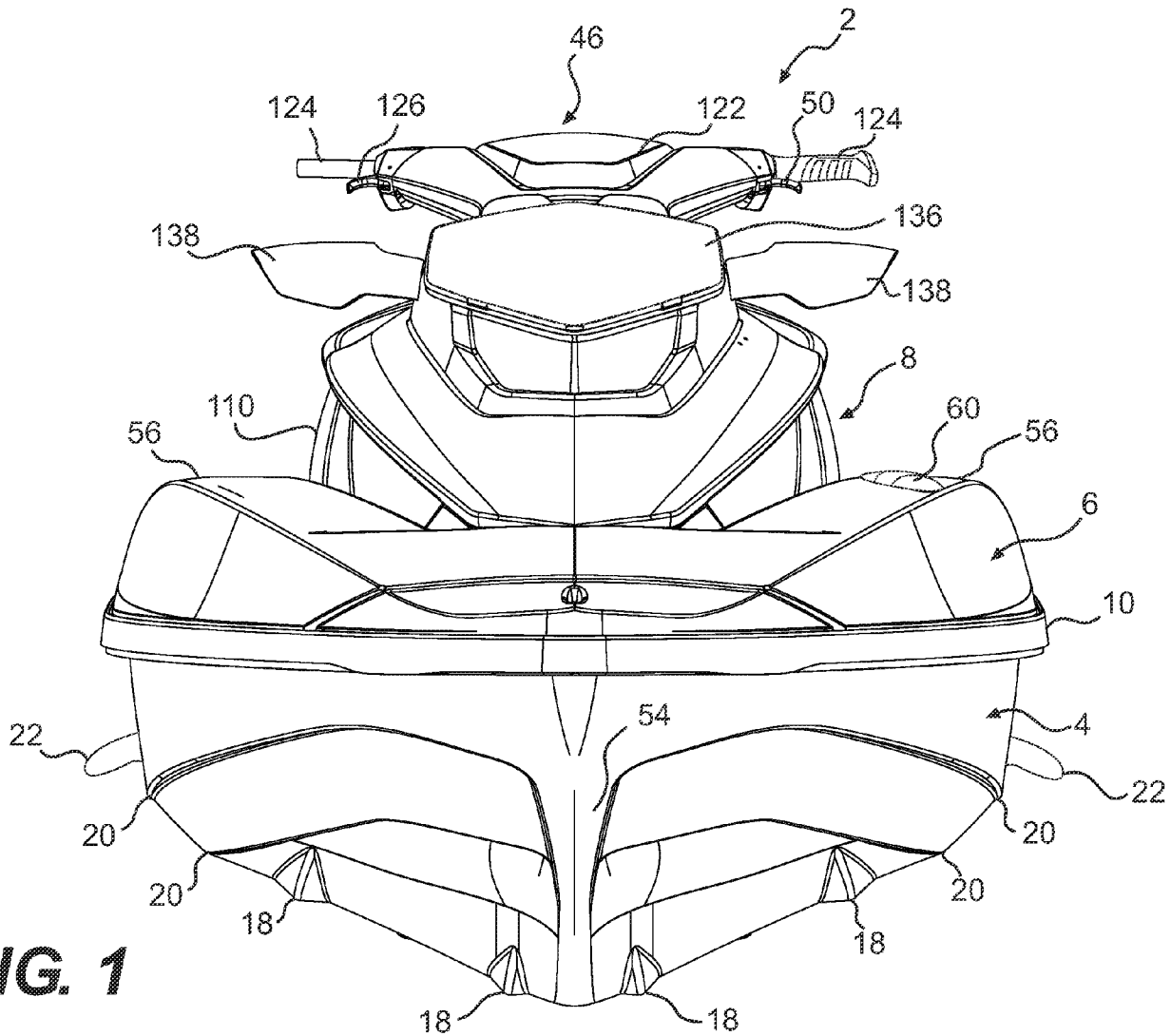
FIG. 1 is a front elevation view of a personal watercraft according to the present invention.

As best seen in FIGS. 1 and 6, the hull 4 is provided with a combination of strakes 18 and chines 20. A strake 18 is a protruding portion of the hull 4. A chine 20 is the vertex formed where two surfaces of the hull 4 meet. It is this combination of strakes 18 and chines 20 that will give, at least in part, the watercraft 2 its riding and handling characteristics.

Sponsons 22 are located on either side of the hull 4 near the transom 24. The sponsons 22 have an arcuate undersurface, which give the watercraft 2 both lift while in motion and improved turning characteristics.

Figure 2:
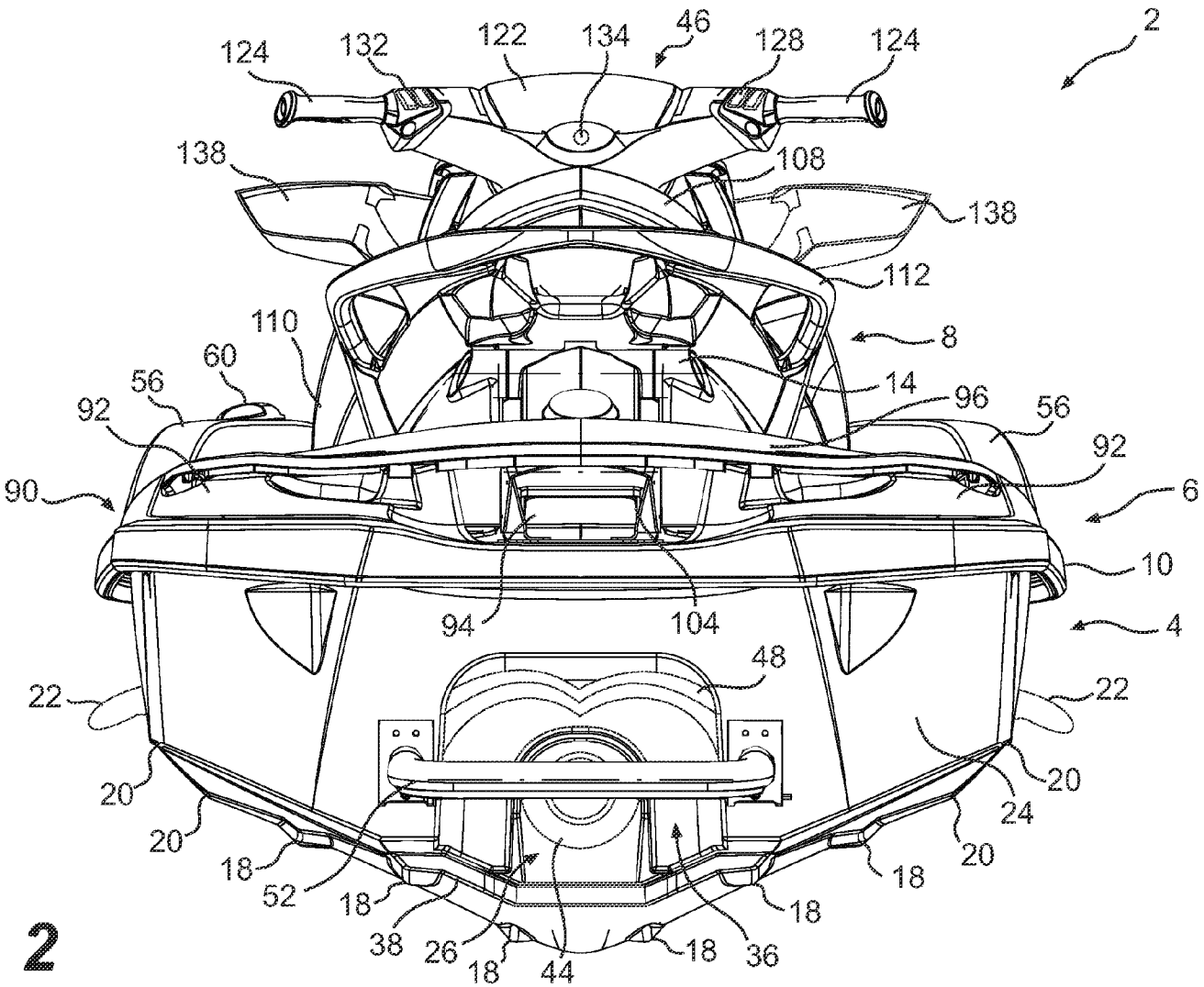
FIG. 2 is a rear elevation view of the watercraft of FIG. 1.
Figure 3:
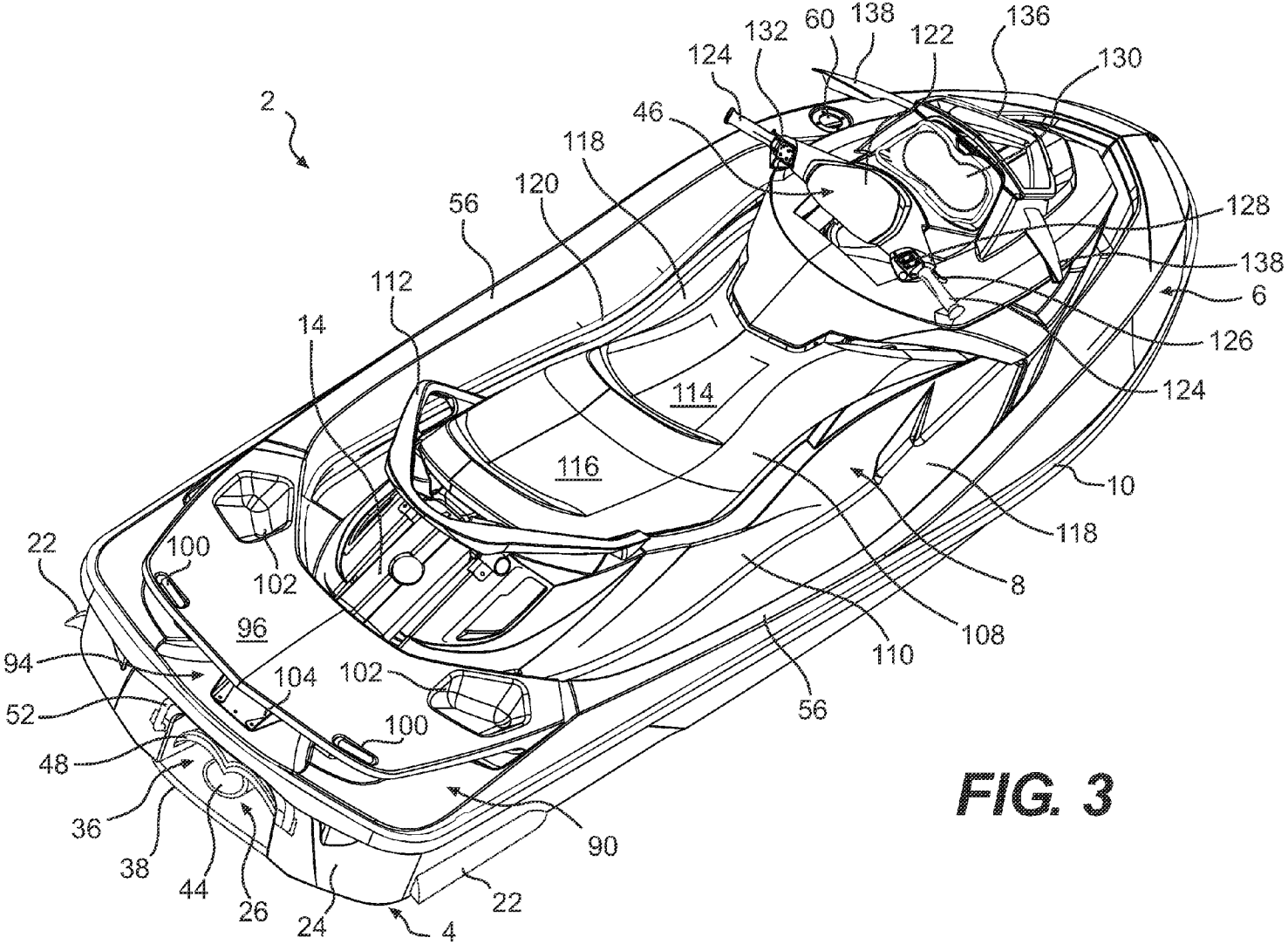
FIG. 3 is a perspective view, taken from a rear, right side, of the watercraft of FIG. 1.
Figure 4:
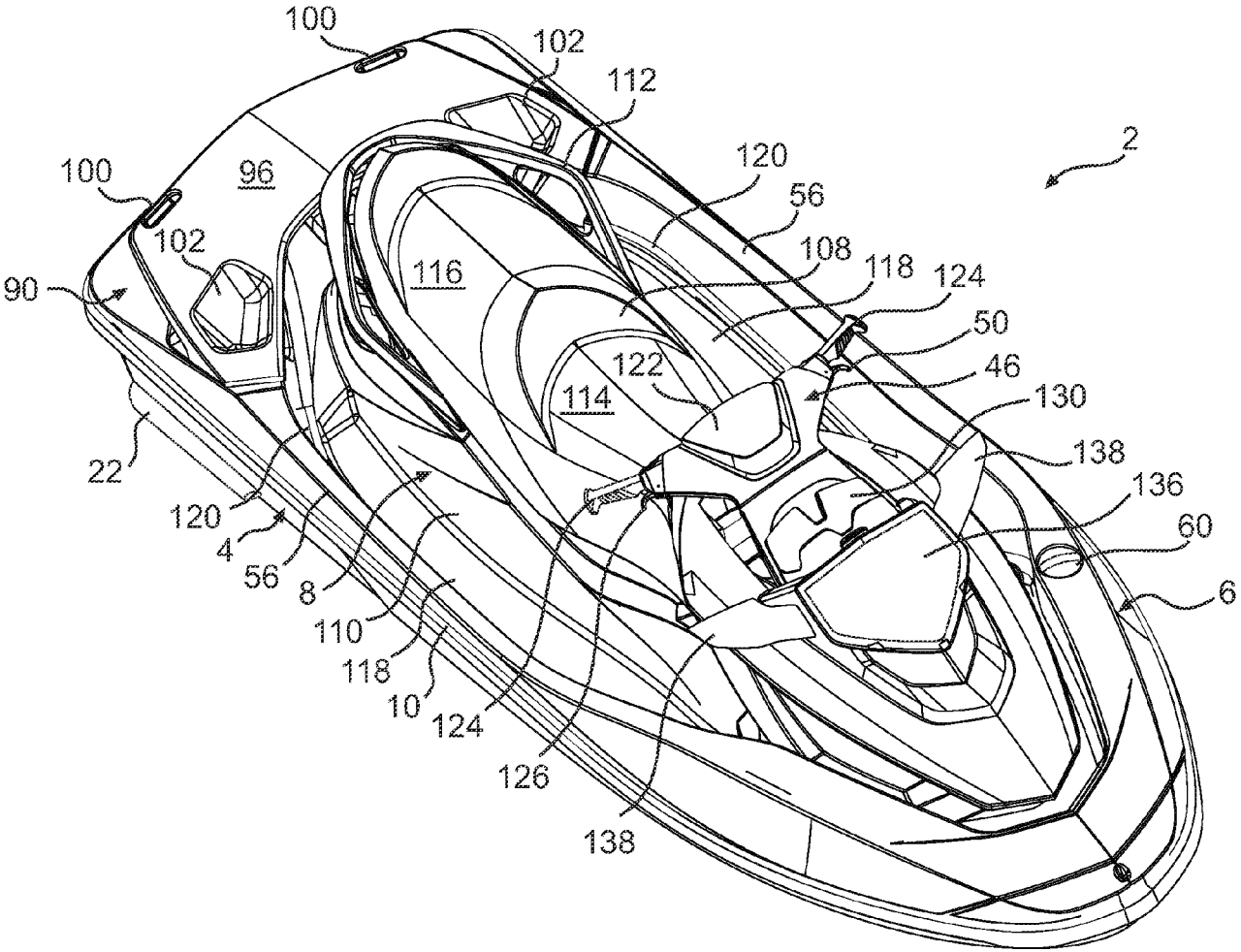
FIG. 4 is a perspective view, taken from a front, right side, of the watercraft of FIG. 1.

As best seen in FIGS. 2 and 8, a jet propulsion system 26 is connected to the hull 4. The jet propulsion system 26 pressurizes water to create thrust. The water is first scooped from under the hull 4 through the inlet grate 28 (FIG. 6). The inlet grate 28 prevents large rocks, weeds, and other debris from entering the jet propulsion system 26 since they may otherwise damage it or negatively affect its performance. Water then flows through a water intake ramp 30. The top portion of the water intake ramp 30 is formed by hull 4 and a ride shoe 32 forms its bottom portion. Alternatively, the intake ramp 30 may be a single piece to which a jet pump unit 34 attaches. In such cases, the intake ramp 30 and the jet pump unit 34 are attached as a unit in a recess in the bottom of hull 4. From the intake ramp 30, water then enters the jet pump unit 34. The jet pump unit 34 is located in what is known as the tunnel 36. The tunnel 36 is opened towards the rear, is defined at the front, sides, and top by the hull 4, and at the bottom by a ride plate 38. The ride plate 38 is the surface on which the watercraft 2 rides or planes. The jet pump unit 34 includes an impeller and a stator (not shown) enclosed in a cylindrical housing. The impeller is coupled to the engine 12 by one or more shafts 40, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump unit 34, it goes through the venturi 42. Since the venturi's exit diameter is smaller than its entrance diameter, the water is accelerated further, thereby providing more thrust. A steering nozzle 44 is pivotally attached to the venturi 42 about a vertical pivot axis. The steering nozzle 44 is operatively connected to a helm assembly 46 disposed on the deck 8 via a push-pull cable (not shown) such that when the helm assembly 46 is turned, the steering nozzle 44 pivots, redirecting the water coming from the venturi 42, so as to steer the watercraft 2 in the desired direction. It is contemplated that the steering nozzle 44 may be gimbaled to allow it to move about a second horizontal pivot axis (not shown). The up and down movement of the steering nozzle 44 provided by this additional pivot axis is known as trim, and controls the pitch of the watercraft 2. It is contemplated that other types of propulsion systems, such as a propeller, could be used.

A reverse gate 48 is pivotally attached to the sidewalls of the tunnel 36. It is contemplated that the reverse gate 48 could alternatively be pivotally attached to the venturi 42 or the steering nozzle 44. The reverse gate 48 is operatively connected to an electric motor (not shown) and the driver of the watercraft can control the position of the reverse gate 48 by pulling lever 50 (FIG. 1) located on the left side of the helm assembly 46 which is in electrical communication with the electric motor. It is contemplated that the reverse gate 48 could alternatively be mechanically connected to a reverse handle to be pulled by the driver. To make the watercraft 2 move in a reverse direction, the reverse gate 48 is pivoted in front of the steering nozzle 44 and redirects the water leaving the jet propulsion system 26 towards the front of the watercraft 2, thereby thrusting the watercraft 2 rearwardly.

A retractable ladder 52, best seen in FIG. 2 in its lowered position, is affixed to the transom 24 to facilitate boarding the watercraft 2 from the water.

Hooks (not shown) are located on the bow and transom 24 of the watercraft 2. These hooks are used to attach the watercraft 2 to a dock when the watercraft 2 is not in use or to a trailer when the watercraft 2 is being transported outside the water.

When the watercraft 2 is in movement, its speed is measured by a speed sensor (not shown) attached to the transom 24 of the watercraft 2. The speed sensor has a paddle wheel which is turned by the flow of water, therefore the faster the watercraft 2 goes, the faster the paddle wheel turns. An electronic control unit (not shown) connected to the speed sensor converts the rotational speed of the paddle wheel to the speed of the watercraft 2 in kilometers or miles per hour, depending on the driver's preference. The speed sensor may also be placed in the ride plate 38 or any other suitable position. Other types of speed sensors, such as pitot tubes, could also be used. It is also contemplated that the speed of the watercraft 2 could be determined from input from a GPS mounted to the watercraft 2.

Turning now to FIGS. 7 to 11, features of the sub-deck 6 will be described. The sub-deck 6 has a pair of generally upwardly extending walls located on either side thereof known as gunwales or gunnels 56. The gunnels 56 help to prevent the entry of water in the watercraft 2 and also provide buoyancy when turning the watercraft 2, since the watercraft 2 rolls slightly when turning. A refueling opening 58 is provided on the front left gunnel 56. A hose (not shown) extends from the refueling opening 58 to the fuel tank (not shown) disposed near the bow 54 in the volume formed between the hull 4 and the sub-deck 6. This arrangement allows for refilling of the fuel tank. A fuel cap 60 (FIG. 1) is used to sealingly close the refueling opening 58, thereby preventing water from entering the fuel tank when the watercraft 2 is in use.

A pedestal 62 is centrally positioned on the sub-deck 6. The pedestal 62 accommodates the internal components of the watercraft 2, such as the engine 12, and shields these components from water. A portion of the rear of the pedestal 62, known as the engine cowling 64 (FIG. 9) can be removed to permit access to the engine 12. The engine cowling 64 is fastened to the remainder of the sub-deck 6 and a seal is disposed between the engine cowling 64 and the remainder of the sub-deck 6 to prevent water intrusion. The top portion of the engine cowling 64 is closed by a removable air intake unit 66. The air intake unit 66 is attached to the pedestal 62 by clips 67. The air intake unit 66 incorporates a system of arcuate passages and baffles which permit air to enter the volume between the hull 4 and the sub-deck 6, and thus be supplied to the engine 12, while reducing the likelihood of water entering that volume. Air enters around the sides of the air intake unit 66, goes through the passages and baffles therein, and then goes down a tube connected to the bottom of the air intake unit 66 and opening near the bottom of the hull 4. Removal of the air intake unit 66 permits access to elements located near the top of the engine 12 which need to be accessed more regularly, such as spark plugs (not shown) or the oil dipstick (not shown). A tow hook (not shown) is provided on the rear portion of the pedestal 62 below the engine cowling 64 to provide an attachment point for towing a water-skier or an inflatable device for example.

An opening 68 is provided in the upper portion of the pedestal 62 forwardly of the engine cowling 64 to permit suspension elements 70 (FIG. 8) of the front suspension assembly 16 to pass therethrough. The suspension elements 70 absorb the loads as the HSD assembly moves relative to the deck 8 and dampen the motion. The suspension elements 70 can include, but are not limited to, one or more springs and a hydraulic damper. It is contemplated that the suspension assembly 16 could include a single suspension element. A bellows 72 (FIG. 8) is sealed around the opening 68 at a lower end thereof and is connected to the deck 8 at an upper end thereof to prevent water from entering the opening 68 while permitting relative movement between the sub-deck 6 and the deck 8. Two openings 74 are provided on the sides of the pedestal 62 forwardly of the opening 68. As seen in FIGS. 8 and 9, these openings 74 allow a front suspension member of the front suspension assembly 16 to be pivotally connected to the deck 8. More specifically, the front suspension member includes a front suspension arm 76 and a shaft 78, and the upper end of the front suspension arm 76 is connected to the shaft 78 which extends through the openings 74 to pivotally connect to the deck 8. It is contemplated that the front suspension member could be made of a single part or that it could be made of more parts. Bellows 80 are connected to the sub-deck 6 around the openings 74 at one end thereof and are connected around brackets (not shown) that are attached to the shaft 78 at the other end thereof. The bellows 80 thus seal and prevent water from entering the openings 74 while permitting relative movement between the sub-deck 6 and the deck 8. Another opening 82 (best seen in FIG. 11) is located in the sub-deck 6 forwardly of the openings 74. Opening 82 allows the passage of two air intake tubes (not shown). Each intake tube has one end opened to a side of the pedestal 62 (one on each side), extends laterally to the other side of the pedestal 62, then moves down near the bottom of the hull 4, thus reducing the likelihood of water entering therethrough in case the watercraft 2 were to flip over. The deck 8 disposed on top of the sub-deck 6 also helps to prevent water from entering the various openings 68, 74, the air intake unit 66, and the air intake tubes by shielding them from direct exposure to water during normal operation. Should any water enter the volume between the hull 4 and the sub-deck 6, it will pool at the bottom of the hull 4 where it will be evacuated by a bilge system (not shown) as is know in the art.

As best seen in FIGS. 7 and 11, side channels 84 are formed between the gunnels 56 and the pedestal 62. The side channels 84 communicate with a recess 86 forward of the pedestal 62. The side channels 84 and the recess 86 receive the lower portions of the deck 8 and permit relative movement between the deck 8 and the sub-deck 6. Rubber mounts 88 (FIG. 7) are connected to the bottom of the side channels 84 to limit the relative movement of the sub-deck 6 towards the deck 8, and thus absorbing some of the impact should they come into contact.

A rear portion 90 of the sub-deck 6 is disposed higher than a bottom of the side channels 84. The rear portion 90 is high enough that, when the watercraft 2 is at rest and under normal loading conditions (i.e. no excess passengers or cargo), the rear portion 90 is disposed above the waterline thus preventing water from infiltrating into the side channels 84 from the back of the watercraft 2. The rear portion 90 has a raised portion on each side thereof forming storage compartments 92. The volume formed by the storage compartments 92 increases the buoyancy of the watercraft 2 and therefore, the lateral stability thereof. A rear channel 94 is formed between the two storage compartments 92. The rear channel 94 is disposed on a lateral center of the sub-deck 6 and its width is selected such that when the watercraft 2 turns (and therefore tilts) water will not enter the side channels 84 from the rear channel 94.

When the watercraft 2 moves forward, the bow 54 raises, thus raising the side channels 84. This permits any water accumulated in the side channels 84 to drain through the rear channel 94.

Figure 12:
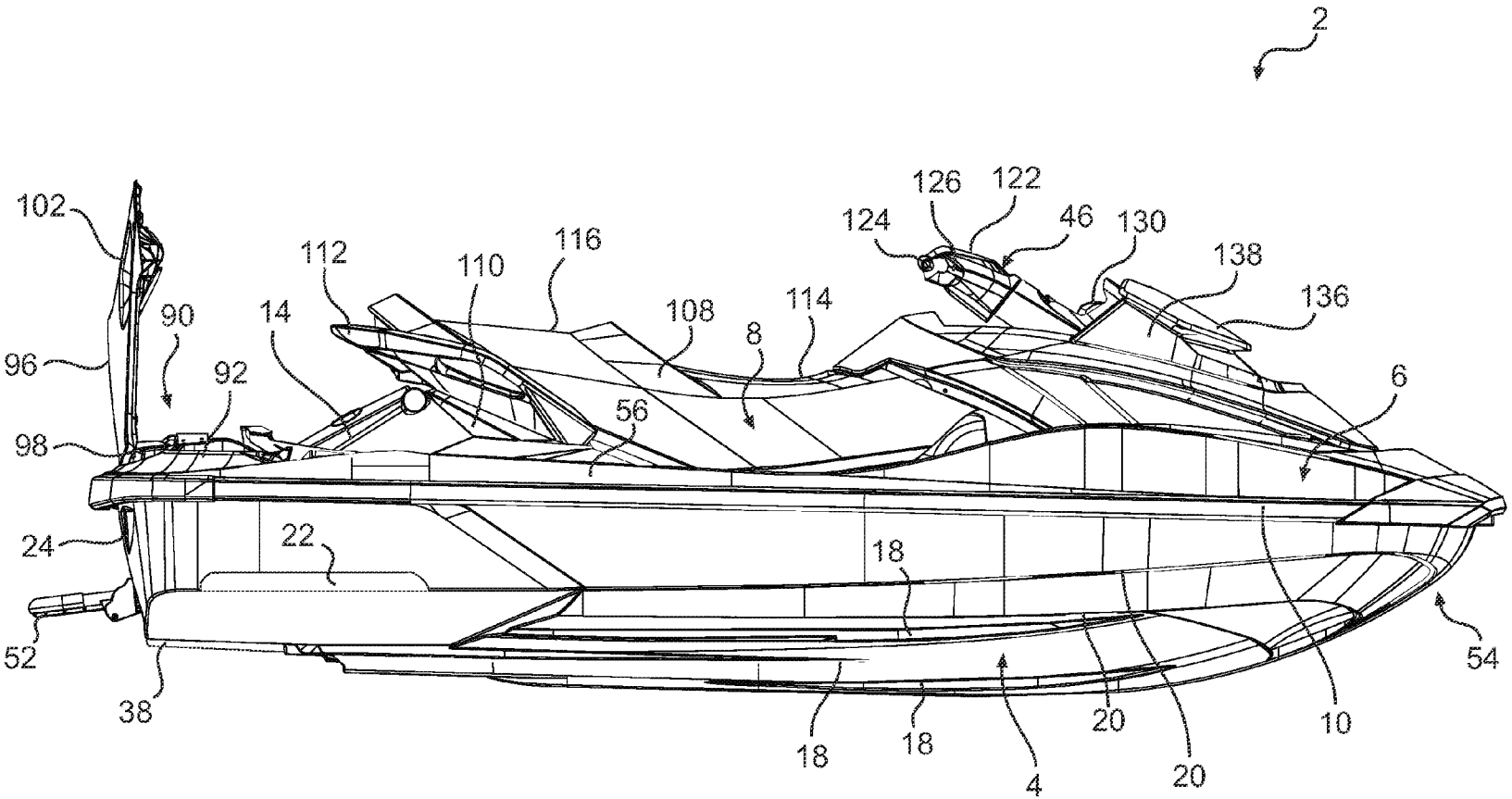
FIGS. 12 and 13 are side elevation views of the watercraft of FIG. 1 according to a first embodiment, showing a rear platform thereof in raised and lowered positions, respectively.

A rear platform 96 is pivotally connected on the rear portion 90 of the sub-deck 6. The platform 96 is pivotable to a raised position, as shown in FIG. 12, in which it permits access to the storage compartments 92. The platform 96 is also pivotable to a lowered position, as shown in FIGS. 2 to 5 and 13, in which the rear platform 96 closes and seals the storage compartments 92, thus eliminating the need of separate lids to accomplish this function. The platform 96 will be described below in further detail.

Turning back to FIGS. 1 to 8, the deck 8 of the watercraft 2 will be described. As previously mentioned, the deck 8 is suspended on the HSD assembly. As seen in FIG. 8, the rear portion of the deck 8 is pivotally connected to the upper end of the rear suspension arm 14. The rear suspension arm 14 extends downwardly and rearwardly from its connection to the rear portion of the deck 8 and the lower end of the rear suspension arm 14 pivotally connects to a bracket 104 on the rear portion 90 of the sub-deck 6. It is contemplated that the bracket 104 could be disposed inside the volume between the hull 4 and the sub-deck 6, with the addition of an opening in the rear portion 90 of the sub-deck 6 and of a bellows similar to bellows 80 extending between the opening and the rear suspension arm 14 to prevent the intrusion of water in the watercraft 2. The front portion of the deck 8 is connected to the front suspension assembly 16. The front portion of the deck 8 is connected, via shaft 78, to the upper end of the front suspension arm 76. The front suspension arm 76 extends downwardly and rearwardly from its connection to the front portion of the deck 8 and the lower end of the front suspension arm 76 pivotally connects to a bracket 106 on the bottom of the hull 4. Suspension elements 70 are connected at their lower ends to the front suspension arm 76 forwardly of the bracket 106 and extend upwardly to connect to the under side of the deck 8 at their upper ends. The force absorption characteristics of the suspension elements 70 can be adjusted by the driver of the watercraft 2 to take into account the load on the deck 8 (i.e. the presence or absence of passengers and/or cargo) and/or to change the riding characteristics of the watercraft 2. The geometry of the rear and front suspension arms 14, 76 is such that as the watercraft 2 moves on the water, the HSD assembly will move rearwardly and upwardly relative to the deck 8 as it encounters waves, thus absorbing the impact thereby providing a more comfortable ride for the driver and passengers, if applicable, since the deck 8 will be more stable.

Figure 13:
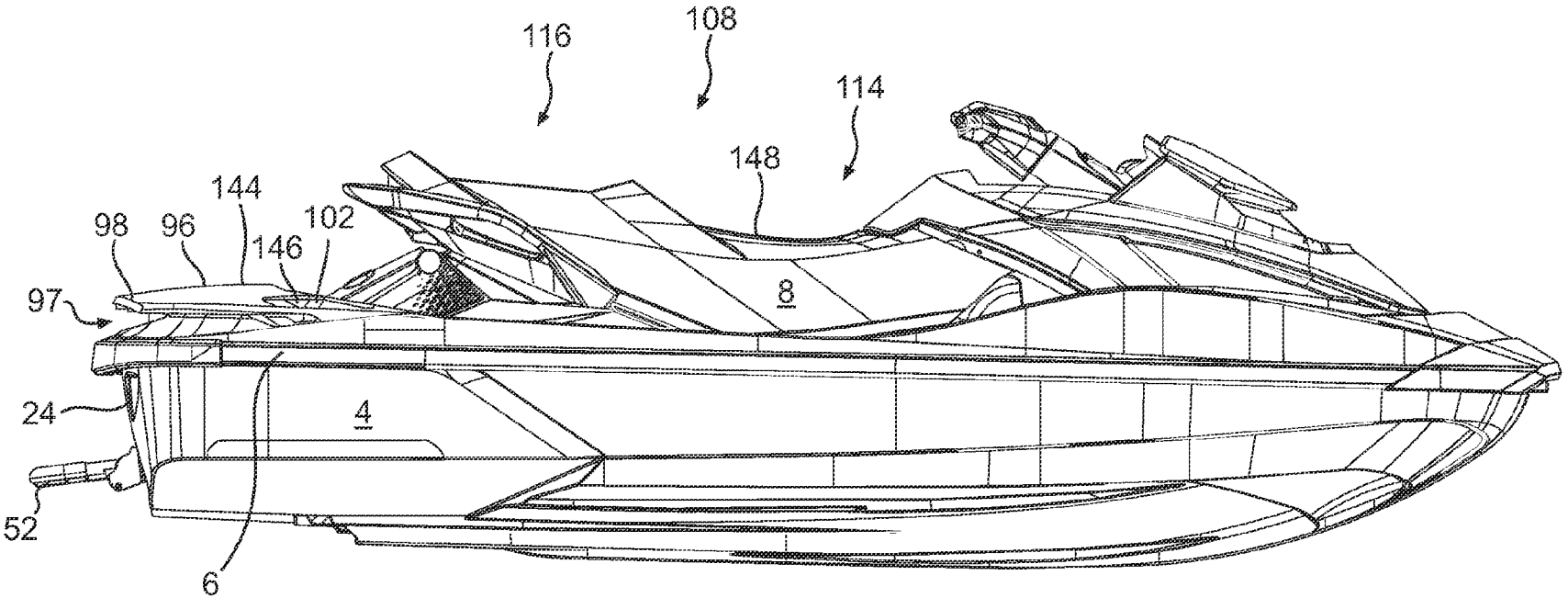

As seen in FIGS. 1 to 5, the deck has a centrally positioned straddle-type seat 108 placed on top of a pedestal 110 to accommodate the driver and passengers in a straddling position. A grab handle 112 is provided between the pedestal 110 and the straddle-type seat 108 at the rear of the straddle-type seat 108 to provide a handle onto which a passenger may hold on. The straddle-type seat 108 has a first seat portion 114 to accommodate the driver and second seat portion 116 to accommodate one or two passengers. The seat 108 is pivotally connected to the pedestal 110 at the front thereof by a system of linkages and is connected at the rear thereof by a latch assembly (not shown). The seat 108 selectively covers an opening (not shown), defined by a top portion of the pedestal 110, which provides access to the air intake unit 66, which once removed, provides access to the upper portion of the engine 12. Referring to FIG. 13, the seat 108 has a seat profile 148, defined as the top edge of the seat 108 as viewed from the side.

Located on either side of the pedestal 110, between the pedestal 110 and the gunnels 56 of the sub-deck 6, are a pair of generally horizontal footrests 118 designed to accommodate the driver's and passengers' feet. By having the footrests 118 form part of the deck 8, the legs of the driver and passengers are not moving with the HSD assembly, and therefore the driver's and passengers' legs are not solicited to absorb part of the impact between the watercraft 2 and the waves. As best seen in FIGS. 5 and 7, a seal 120 is disposed between each footrest 118 and its corresponding gunnel 56 on the sub-deck 6. The seals 120 do not need to make the space between the footrests 118 and the gunnels 56 watertight since any water that enters in the side channels 84 located below can be evacuated through the rear channel 94. The seals 120 are there to prevent objects from falling through that space and then falling in the side channels 84, which would make these objects difficult to recover without removing the deck 8. Since an upper end of the side channels 84 is wider than a lower end of the side channels 84, the seals 120 are preferably made of a flexible material, such as rubber, that can compress and expand to follow the inner side of the gunnels 56 as the HSD assembly moves relative to the deck 8. The footrests 118 are preferably covered by carpeting made of a rubber-type material to provide additional comfort and feet traction.

As best seen in FIGS. 2 and 5, the helm assembly 46 is positioned forwardly of the straddle-type seat 108. As previously mentioned, the helm assembly 46 is used to turn the steering nozzle 44, and therefore the watercraft 2. The helm assembly 46 has a central helm portion 122 that may be padded, and a pair of steering handles 124. The right steering handle 124 is provided with a throttle lever 126 allowing the driver to control the speed of the watercraft 2. The left steering handle is provided with a lever 50 to control the position of the reverse gate 48, as previously mentioned. The central helm portion 122 has buttons 128 that allow the driver to modify what is displayed (such as speed, engine rpm, and time) on the display cluster 130 located forwardly of the helm assembly 46. Additional buttons 132 are provided on the helm portion 122 to allow the driver to adjust the force absorption characteristics of the suspension elements 70. The helm assembly 46 is also provided with a key receiving post 134 near a center thereof. The key receiving post 134 is adapted to receive a key (not shown) attached to a lanyard (not shown) so as to allow starting of the watercraft 2. It should be noted that the key receiving post 134 may alternatively be placed in any suitable location on the watercraft 2. The helm assembly 46 is preferably pivotable about a horizontal axis to allow the height of the helm assembly 46 to be adjusted to suit the driver's preference. The display cluster 130 also preferably moves about the horizontal axis with the helm assembly 46.

The deck 8 is provided with a hood 136 located forwardly of the helm assembly 46. A hinge (not shown) is attached between a forward portion of the hood 136 and the deck 8 to allow hood 136 to move to an opened position to provide access to a front storage bin (not shown). A latch (not shown) located at a rearward portion of hood 136 locks hood 136 into a closed position. When in the closed position, hood 136 prevents access to the front storage bin. Rearview mirrors 138 are positioned on either side of hood 136 to allow the driver to see behind the watercraft 2 while driving.

Turning to FIGS. 13 to 16, and referring back to FIGS. 2-5 and 12, the rear platform 96 will now be described in greater detail.

Figure 14:
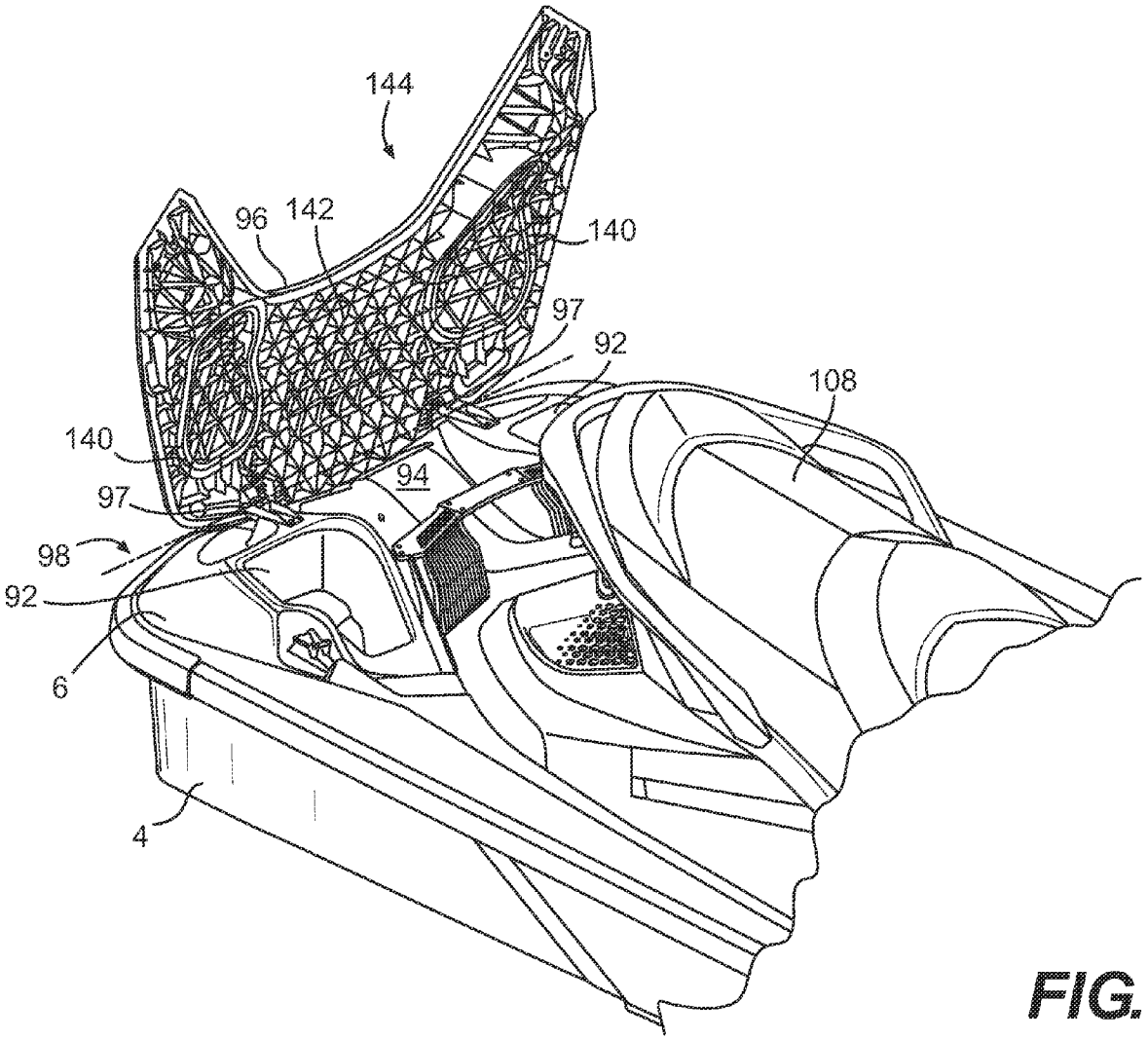
FIG. 14 is a perspective view, taken from a front, right side, of the rear portion of the watercraft of FIG. 1 showing the rear platform in the raised position.

Referring generally to FIGS. 12, 13 and 14, the platform 96 is pivotally connected on the rear portion 90 of the sub-deck 6. The platform 96 preferably pivots about two hinges 97 located near the transom 24. The hinges 97 define a pivot axis 98 (FIGS. 5, 12 and 13) located near the transom 24 and extending transversely across the sub-deck 6. It is contemplated that a single hinge 97 or more than two hinges 97 may alternatively be used. The platform 96 can be pivoted to a raised position, as shown in FIG. 12. In the raised position, the platform 96 permits a rider of the watercraft 2 to access to the storage compartments 92 and any objects that may be stored therein. The platform 96 is preferably substantially vertical in the raised position, to allow unobstructed access to the interior of the storage compartments 92. The platform 96 can also be pivoted to a lowered position, as shown in FIG. 13. In the lowered position, the platform 96 closes the storage compartments 92, thus eliminating the need of separate lids to accomplish this function. The platform 96 is preferably made of molded plastic, though any other suitable material known in the art may alternatively be used. Referring to FIG. 14, the lower surface 142 of the platform 96 is provided with a honeycomb structure for increased rigidity, so that the platform 96 can support the weight of one or more persons standing thereon, for example while boarding the watercraft 2.

Referring to FIG. 14, the platform 96 is designed such that when it is in the lowered position it seals the storage compartments 92 in order to prevent water from entering the storage compartments 92 from the body of water while the watercraft 2 is in use. Left and right rubber sealing rings 140 are disposed on the underside 142 of the platform 96, such that when the platform 96 is in the lowered position the rings 140 abut against the portion of the sub-deck 6 that forms the outer perimeter of the respective left and right storage compartments 92. When the platform 96 is in the lowered position, the rings 140 are preferably compressed between the platform 96 and the outer perimeter of the storage compartments 92 to form a water-tight seal. It is contemplated that the rings 140 may alternatively be disposed on the outer perimeter of the storage compartments 92. It is additionally contemplated that the rings 140 may be made of any other suitable material, or that any other suitable type of seal may be used such as a tortuous path.

When the platform 96 is in the lowered position, as shown in FIGS. 2 to 5 and 13, the generally horizontal top surface 144 of the platform 96 provides a surface on which one or more riders of the watercraft 2 may stand when the watercraft 2 is at rest, for example while boarding the watercraft 2. The top surface 144 is preferably an anti-slip surface made of a rubber-type material, which provides additional comfort and feet traction on the rear platform 96. It is contemplated that the anti-slip surface may alternatively be made of any other suitable material, or that the top surface 144 may alternatively be textured to provide the anti-slip surface. The platform 96 is configured so that it is lower than the seat profile 148 (seen in FIG. 13) when in the lowered position, to facilitate the use of the top surface 144 for boarding the watercraft 2 via the platform 96.

Referring to FIGS. 2 to 5 and 13, the top surface 144 of the platform 96 is provided with left and right heel rests 102 in the form of recesses respectively disposed on left and right sides of the longitudinal centerline of the watercraft 2. The heel rests 102 are disposed generally rearwardly of the seat 108 when the platform 96 is in the lowered position. Because the height of the platform 96 is lower than the seat profile 148 when the platform 96 is in the lowered position, the heel rests 102 can be positioned to conveniently receive the heels of a rearwardly-facing passenger. Each heel rest 102 has an angled portion 146 that slopes upwardly from the front of the watercraft 2 toward the rear of the watercraft 2, for receiving the heels of a passenger sitting on the rear portion of the seat 108 and facing rearwardly, for example while spotting a water-skier being towed by the watercraft 2. When the heel rests 102 receive the heels of a rearwardly-facing passenger, the angled portions 146, provide additional stability for the heels of the passenger. It is contemplated that the heel rests 102 may alternatively be protrusions extending upward from the top surfaces 144

The platform 96 is additionally provided with grab handles 150 to assist a rider who desires to board the watercraft 2 from the water, by placing his feet on the ladder 52 and placing his hands on the grab handles 150. The grab handles 150 are positioned close to the rear of the platform 96, and are positioned close to the axis 98, so that the force exerted by the rider on the grab handles 150 does not create a large enough upward moment about the axis 98 to pivot the platform 96 from the lowered position to the raised position. The axis 98 preferably passes through the grab handles 150, such that a force exerted on the grab handles 150 will produce no moment about the axis 98.

Figure 15:
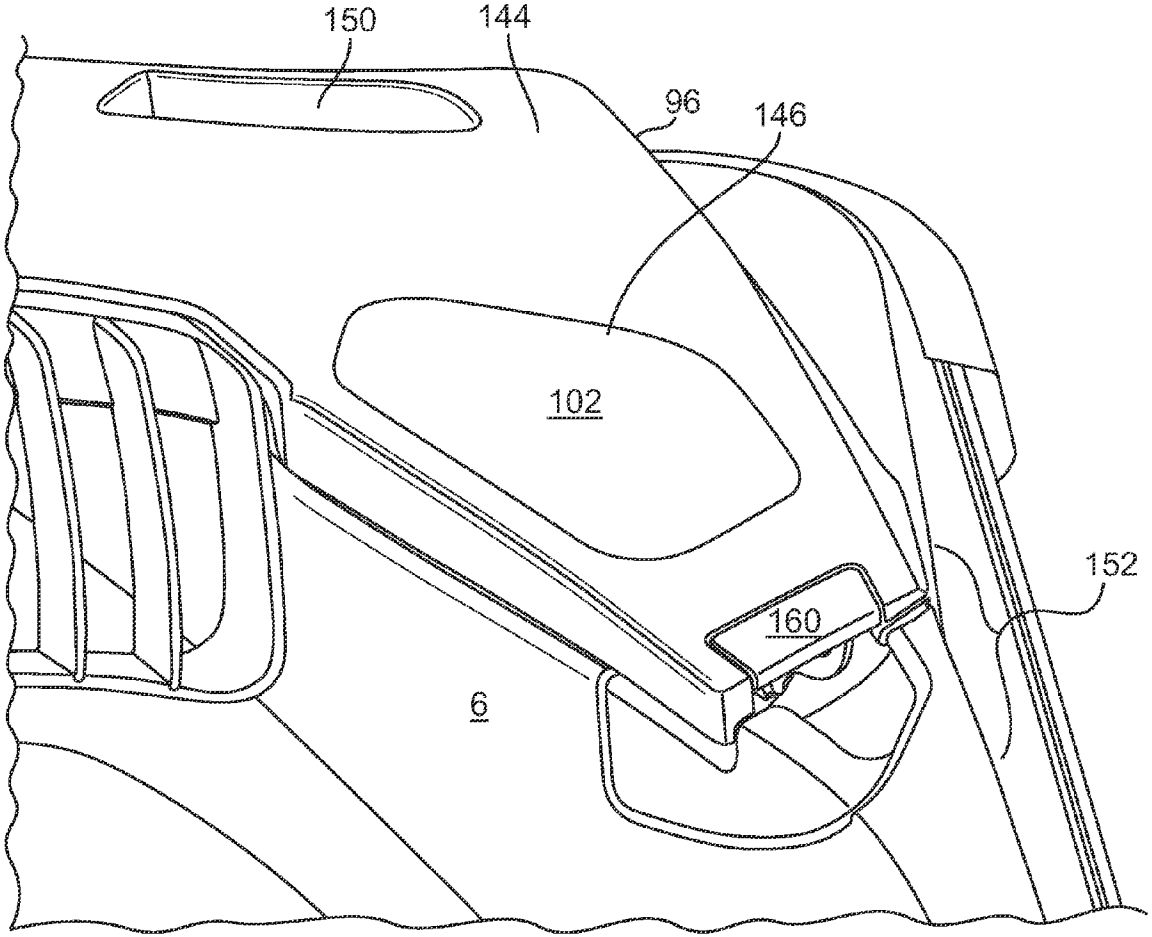
FIG. 15 is a perspective view, taken from the front, of a portion of the rear platform showing one latch assembly.
Figure 16:
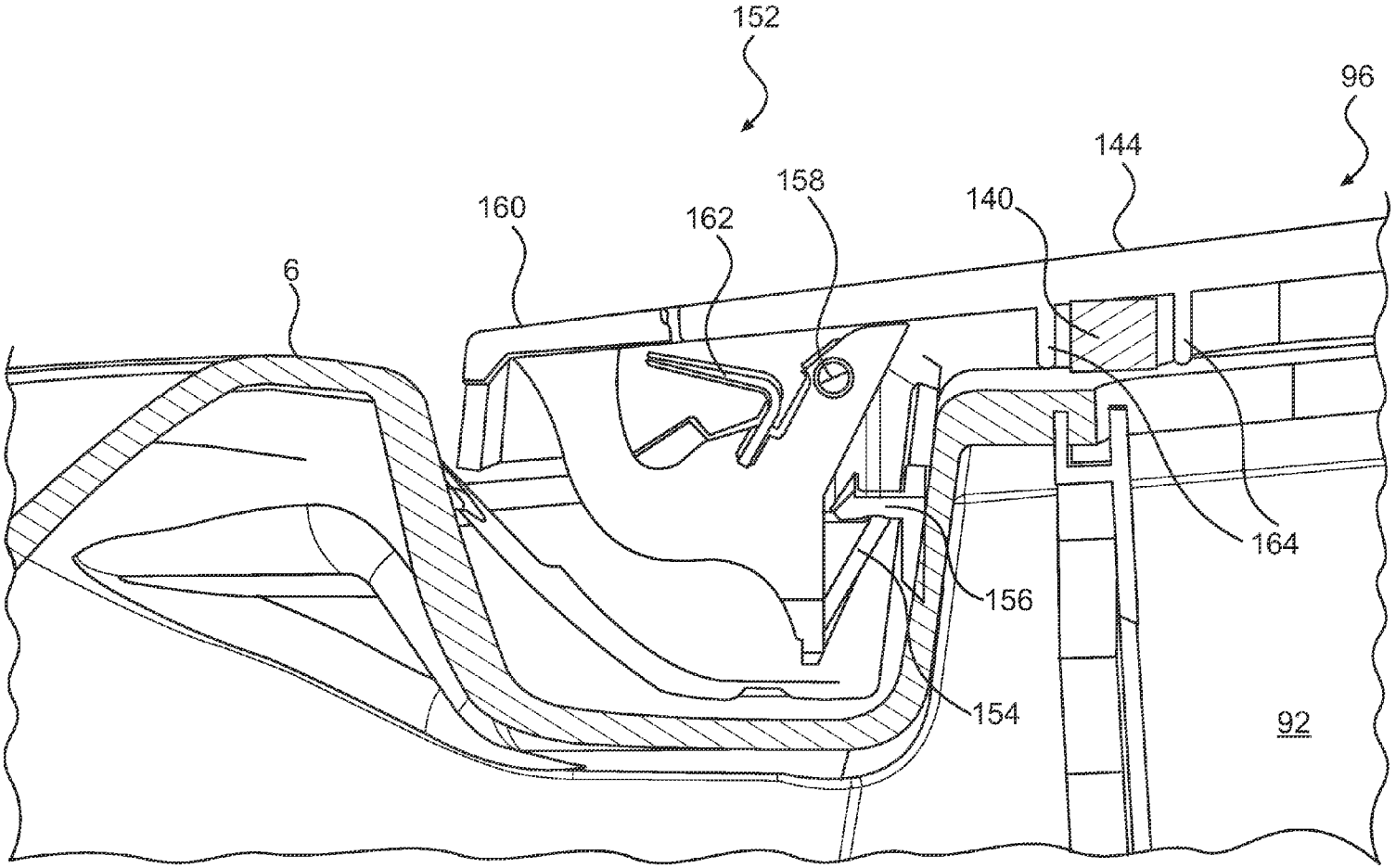
FIG. 16 is a cross-sectional view of the latch assembly of FIG. 15.

Referring now to FIGS. 15 and 16, a pair of latch assemblies 152 are provided on either side of the platform 96 to maintain the platform 96 in the lowered position. Only one latch assembly 152 will be described in detail, and it should be understood that the other latch assembly 152 functions in substantially the same manner. Referring to FIG. 16, a latch 154 of the latch assembly 152 is mounted to the forward portion of the platform 96 and a corresponding ledge 156 is mounted to the rear portion of the HSD assembly. When the platform 96 is in the lowered position, the latch 154 abuts against the ledge 156, thereby maintaining the platform 96 in the lowered position. The latch assembly 152 can be released by actuating the release lever 160 against the force of the spring 162, thereby pivoting the latch 154 about the axis 158 and permitting the platform 96 to be moved to the raised position when both latch assemblies 152 are released. The latch assembly 152 is preferably positioned and configured such that the rings 140 are compressed to provide a watertight seal for the respective storage compartments 92 when the platform 96 is in the lowered position. Bumpers 164 are provided to protect the rings 140 from being overly compressed and damaged due to the weight of one or more people or a similar load on top of the platform 96. In this configuration, the platform 96 is firmly maintained in the lowered position, and provides a stable surface 144 on which a person can stand while the watercraft 2 is at rest. It is contemplated that the latch assembly 152 may additionally include a safety latch (not shown). When the platform 96 is pivoted toward the lowered position using minimal force, it comes to rest on the HSD assembly but the rings 140 are not necessarily sufficiently compressed to form a watertight seal and the latch 154 does not engage the ledge 156. In this position, the safety latch engages the ledge 156 and prevents the platform 96 from returning to the upward position. The platform 96 may then be placed in the lowered position by exerting thereon a sufficient downward force to compress the rings 140 and move the latch 154 into engagement with the ledge 156. It is contemplated that the platform 96 may have only one latch 152, or more than two latches 152. It is additionally contemplated that any suitable type of latch known in the art may alternatively be used, such as a friction type clip that disengages when the platform 96 is pushed or pulled upward with sufficient force.

Figure 17:
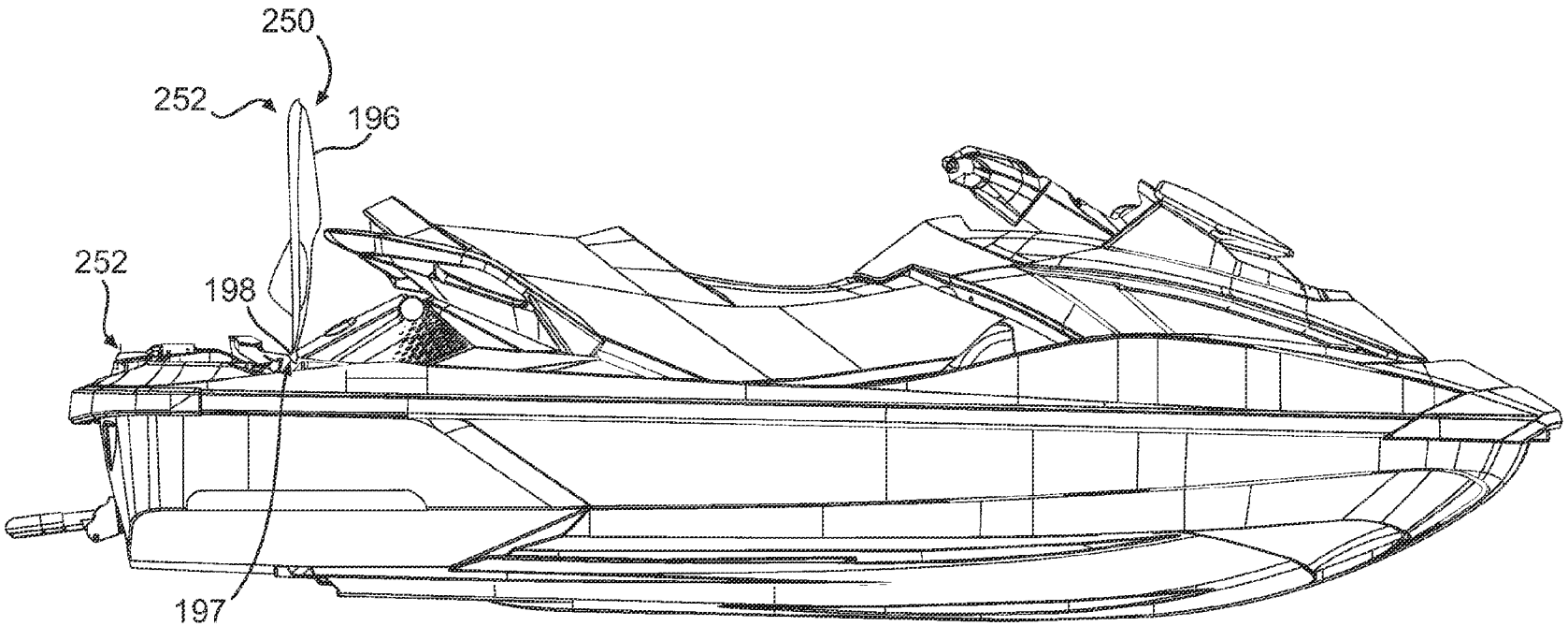
FIG. 17 is a side elevation view of a watercraft according to a second embodiment, showing the rear platform thereof in a raised position.

Referring now to FIG. 17, according to a second embodiment, the platform 196 pivots between the raised and lowered positions about two hinges 197 located near the forward end of the platform 196. The hinges 197 define an axis 198 extending transversely across the sub-deck 6. It is contemplated that a single hinge 97 or more than two hinges 97 may alternatively be used. The platform 196 pivots upward and forward from the lowered position (shown in FIG. 13) to the raised position (shown in FIG. 17). In this embodiment, the latch assembly 252 is positioned toward the rear of the platform 196. In this configuration, the positioning of the grab handles 250 relative to the axis 198 when the platform 196 is in the lowered position (not shown) is unimportant, because the force exerted by a person on the grab handles 250 while boarding the watercraft 2 would either be directed downward, thereby urging the platform 196 toward the lowered position, or directed away from the axis 198, thereby exerting no upward moment on the platform 196.

Figure 18:
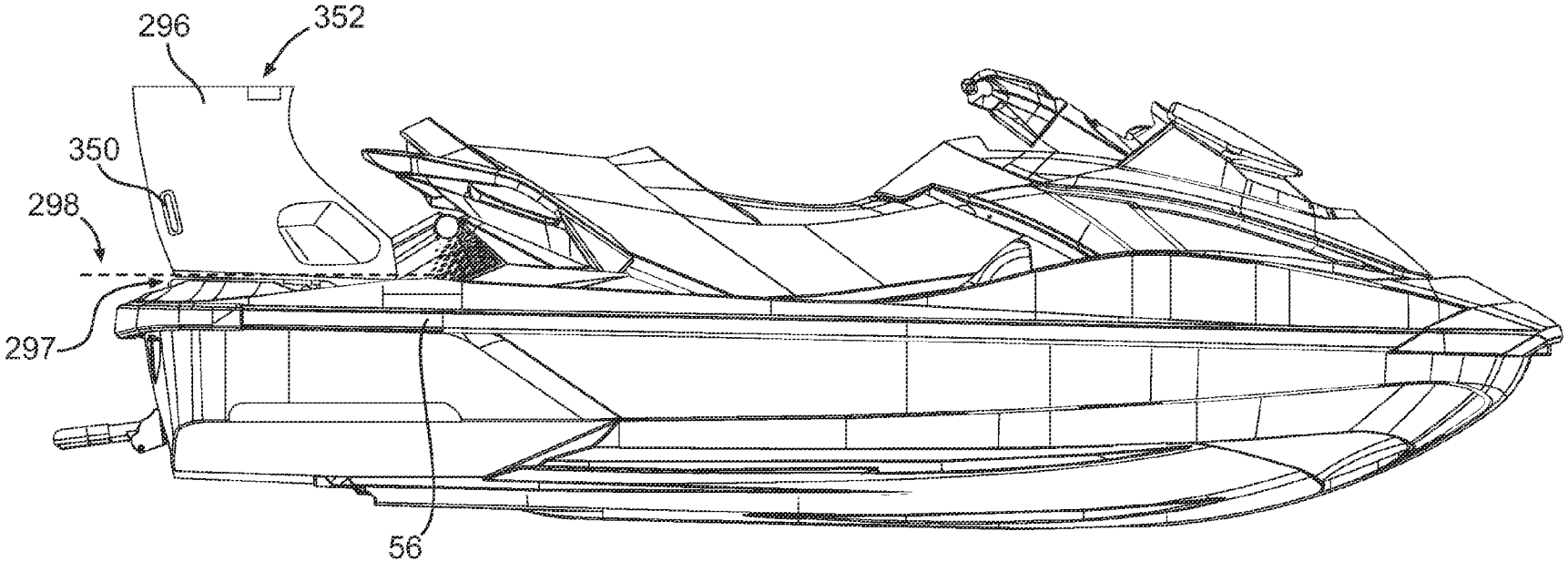
FIG. 18 is a side elevation view of a watercraft according to a third embodiment, showing the rear platform thereof in a raised position.

Referring now to FIG. 18, according to a third embodiment, two platforms 296 (one of which is shown in FIG. 18) pivot between the respective raised and lowered positions about respective hinges 297 positioned near the outside lateral edges of the respective platforms 296 near the gunnels 56. Each hinge 297 defines a respective longitudinally-oriented axis 298. The platforms 296 pivot upward and laterally outward from the lowered position (shown in FIG. 13) to the raised position (shown in FIG. 18) about the respective axes 298. In this embodiment, the latch assembly 352 is positioned toward the laterally inward edges of the platforms 296. In this configuration, the positioning of the grab handles 350 relative to the axis 298 when the platform 196 is in the lowered position (not shown) is unimportant, because the force exerted by a person on the grab handles 350 while boarding the watercraft 2 would either be directed downward, thereby urging the platform 296 toward the lowered position, or directed rearward parallel to the axes 298, thereby exerting no upward moment on the platform 296.

It is contemplated that the sub-deck 6 and deck 8 of the watercraft 2 may alternatively be formed integrally as a single deck 8. In this configuration, the watercraft 2 would appear substantially similar to the watercraft 2 in FIG. 5 when seen from above, with the exception that the watercraft 2 would have no seal 120 because the sub-deck 6 and deck 8 of the watercraft 2 would be formed integrally. In this configuration, the storage compartments 92 would be formed in a rear portion of the deck 8, and would look substantially similar to those shown in FIG. 14. All of the other components of the watercraft 2, including the platform 96, would function similarly to the corresponding components described above.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A personal watercraft comprising:

a hull;

a deck disposed above the hull;

a raised portion protruding from a rear portion of the watercraft;

an engine disposed at least in part in the hull;

a propulsion system connected to the hull and operatively connected to the engine;

a helm assembly disposed on the deck;

a straddle-type seat disposed on the deck at least in part rearwardly of the helm assembly, the seat having a seat profile;

a storage compartment disposed at least in part rearwardly of the seat, the raised portion of the rear portion forming at least in part the storage compartment; and a rear platform pivotally connected to the rear portion of the watercraft, the rear platform extending laterally across the rear portion of the watercraft, the rear platform being pivotable relative to the hull about a pivot axis between a raised position and a lowered position, the rear platform permitting access to the storage compartment when in the raised position, the rear platform sealingly closing the storage compartment when in the lowered position;

a rearward portion of the rear platform has at least one grab handle disposed thereon, the pivot axis being longitudinally aligned with the at least one grab handle;

a highest point of the rear platform being disposed lower than the seat profile when the rear platform is in the lowered position.

2. The personal watercraft of claim 1, further comprising a sub-deck disposed on the hull, the hull and sub-deck together forming a hull and sub-deck (HSD) assembly, wherein:

the engine is disposed in the HSD assembly;

the deck is disposed above the sub-deck; and the raised portion protrudes from the sub-deck.

3. The personal watercraft of claim 1, further comprising a sealing ring disposed on one of the rear platform and an outer edge of the storage compartment, wherein the rear platform sealingly closes the storage compartment when in the lowered position by compressing the sealing ring between the rear platform and the outer edge of the storage compartment.

4. The personal watercraft of claim 2, further comprising a latch having a first portion disposed on the rear platform and a second portion disposed on one of the deck and the sub-deck; and wherein the first portion selectively engages the second portion when the rear platform is in the lowered position and prevents the rear platform from moving to the raised position.

5. The personal watercraft of claim 1, wherein the pivot axis is disposed rearwardly of the storage compartment and oriented generally transversely.

* * * * *